US005253419A

United States Patent [19]

Collot et al.

[11] Patent Number: 5,253,419

[45] Date of Patent: Oct. 19, 1993

[54] METHOD OF MANUFACTURING A HOLLOW BLADE FOR A TURBOSHAFT ENGINE

[75] Inventors: André C. F. Collot, Mennecy; Bernard P. C. Sohier, Savigny Le Temple; Danilo Varela, Sevres, all of France

[73] Assignee: Societe Nationale d'Etude et de Construction de Moteurs d'Aviation "S.N.E.C.M.A.", Paris, France

[21] Appl. No.: 581

[22] Filed: Jan. 4, 1993

Related U.S. Application Data

[63] Continuation of Ser. No. 837,958, Feb. 20, 1992, abandoned.

[30] Foreign Application Priority Data

Feb. 20, 1991 [FR] France ..... 91 02007

[51] Int. Cl.[5] ..... B23D 15/00

[52] U.S. Cl. ..... 29/889.72

[58] Field of Search ..... 29/889.72, 889.7, 463; 228/157, 193, 234, 236, 243

[56] References Cited

U.S. PATENT DOCUMENTS 4,642,863 2/1987 Schulz ..... 29/889.72
4,882,823 11/1989 Weisert et al. .

FOREIGN PATENT DOCUMENTS 0245548 11/1987 European Pat. Off. .
1577388 8/1969 France .
2286688 4/1976 France .
2304438 10/1976 France .
2647373 11/1990 France .

OTHER PUBLICATIONS

Sheet Metal Industries, Vol. 66, No.:10 October, 1989, Redhill, Surrey, Great Britain; 507-8, 510-11 R. Pearce: Advanced Sheet Metal Technology for the Aerospace Industry.

*Primary Examiner*—Irene Cuda
*Attorney, Agent, or Firm*—Oblon, Spivak, McClelland, Maier & Neustadt

[57] ABSTRACT

A hollow blade for a turboshaft engine, such as a fan rotor blade of large chord, is manufactured by a method in which primary components including two outer metal sheets and at least one intermediate sheet are hot formed so that the components are curved and twisted to a desired shape, diffusion barriers are formed at selected Positions on the intermediate sheet, the shaped components are assembled and located on suitable process tooling, the assembled components are diffusion welded together, the welded assembly is internally pressurized by gas to inflate and superplastically deform selected areas to form a hollow in said assembly, and performing finishing operations on the hollow assembly to obtain the hollow blade.

8 Claims, 2 Drawing Sheets

FIG. 1
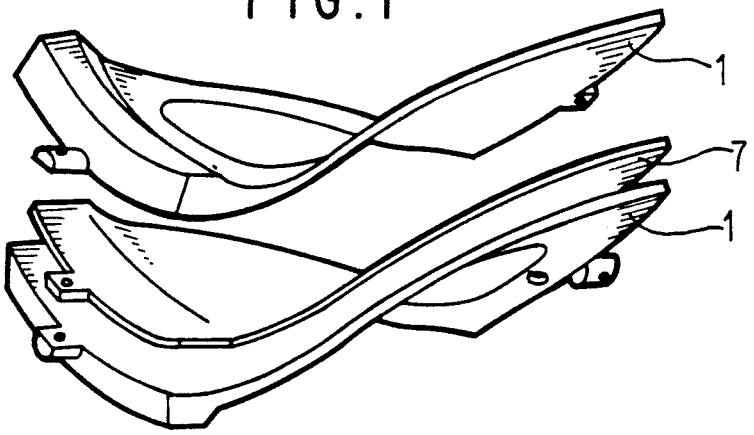
FIG. 2
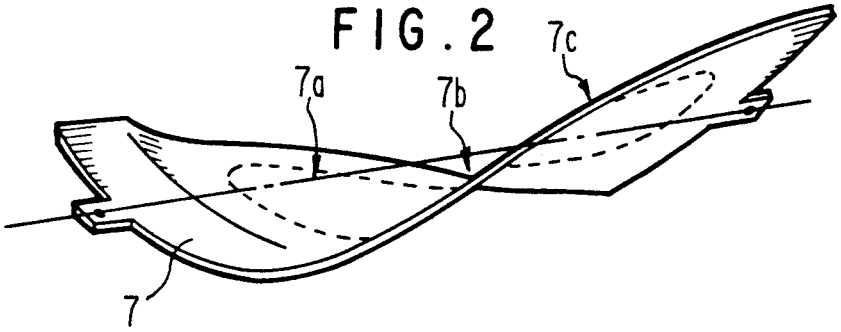
FIG. 3
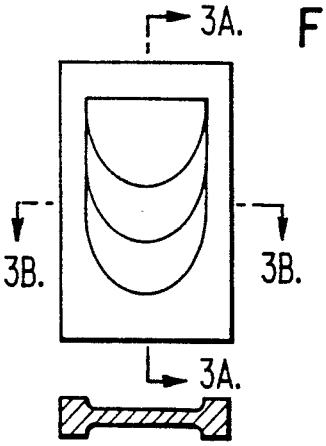
FIG. 3B
FIG. 3A
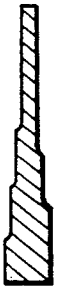
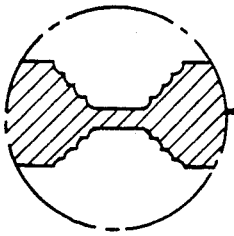
FIG. 3C
FIG. 3D
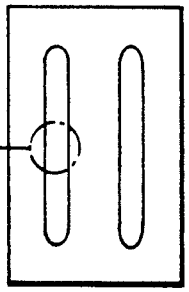
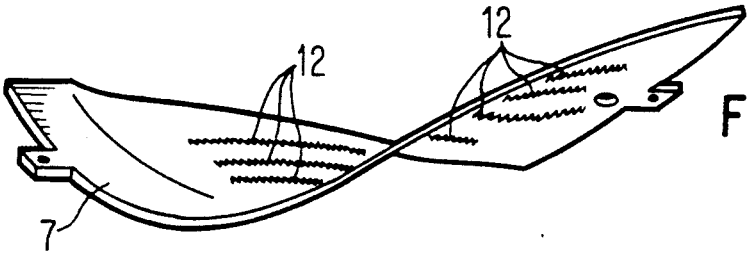
FIG. 4

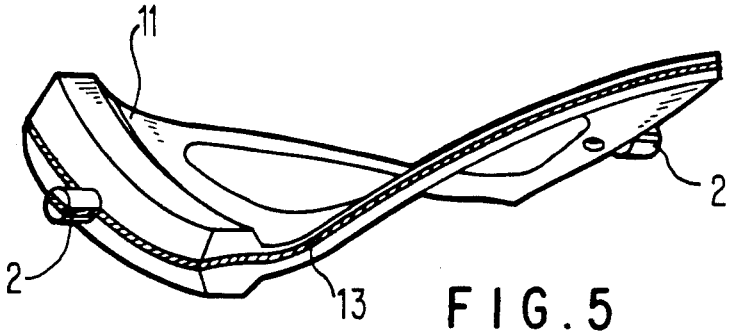
FIG. 5
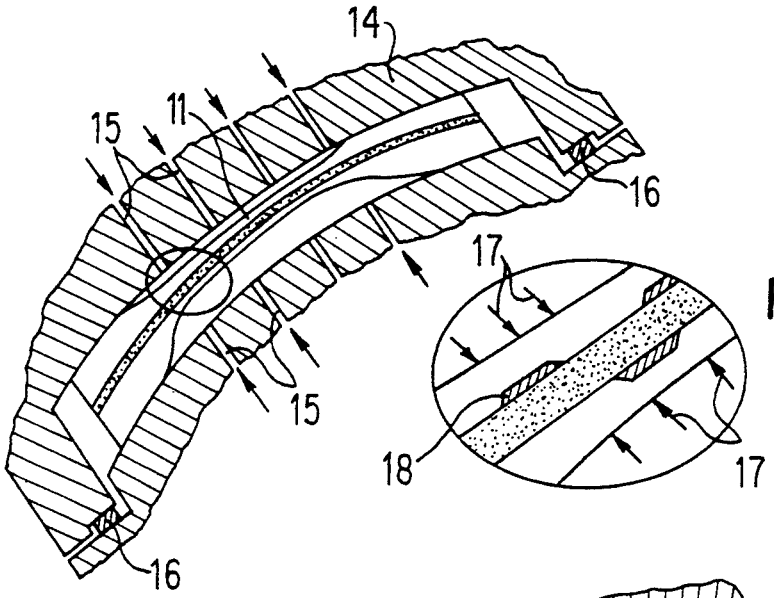
FIG. 6A
FIG. 6B
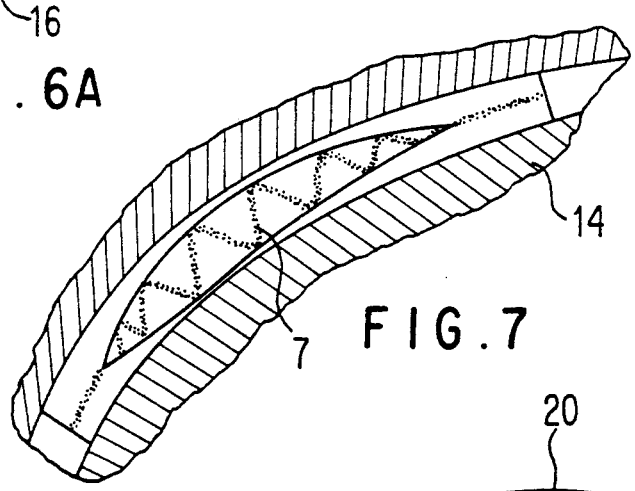
FIG. 7
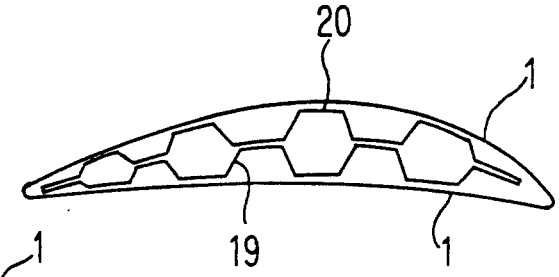
FIG. 8
FIG. 9
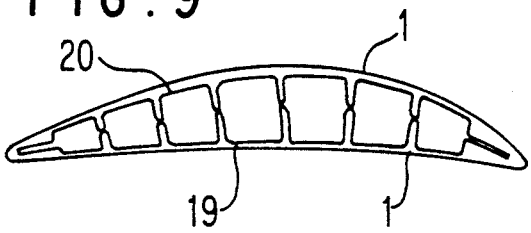

METHOD OF MANUFACTURING A HOLLOW BLADE FOR A TURBOSHAFT ENGINE

This application is a division of U.S. application Ser. No. 07/837,958, filed on Feb. 20, 1992, now abandoned.

BACKGROUND OF THE INVENTION

FIELD OF THE INVENTION

The present invention relates to a method of manufacturing a hollow blade for a turboshaft engine, particularly a blade of large chord.

The advantages stemming from the use of large chord blades in turboshaft engines are particularly evident in the case of the fan rotor blades of a turbojet by-pass engine. These blades must meet severe operating conditions and, in particular, have adequate mechanical characteristics associated with anti-vibration properties and resistance to impacts by foreign bodies. The desire for adequate speeds at the blade tips has furthermore led to seeking a reduction in the mass of the blades, which aim may be achieved, in particular, by the use of hollow blades.

SUMMARY OF THE INVENTION

FR-A-1 577 388 discloses one example of the construction of a blade comprising two wall elements between which a honeycomb structure is mounted, the wall elements preferably being made of titanium alloy and being formed to the desired shape and form by hot pressing.

Known also from FR-A-2 286 688 and FR-A-2 304 438 is a method of making a metallic structure from several parts comprising an operation involving superplastic deformation at high temperature by applying pressure with an inert fluid in tooling suited to the purpose, associated with diffusion welding.

SUMMARY OF THE INVENTION

The aim of the invention is to provide an alternative method of carrying out the manufacture of parts constructed from at least three metal sheets and having, if need be in the case of rotary parts, a controlled mass distribution relative to a centrifugal field, the method permitting, in particular, the manufacture of fan blades of large chord.

To this end, according to the invention there is provided a method of manufacturing a hollow blade for a turboshaft engine, particularly a fan rotor blade of large chord, said method comprising the following steps:

(a) providing primary components consisting of two outer metal sheets and at least one intermediate metal sheet;

(b) hot forming said primary components wherein said components are curved and twisted to a desired shape;

(c) putting in place diffusion barriers at selected positions on said at least one intermediate sheet;

(d) assembling and putting said components in place on suitable process tooling;

(e) diffusion welding said assembled components together at said selected positions of said diffusion barriers;

(f) internally gas pressurizing selected areas of the welded assembly of said primary components to inflate and superplastically deform said assembly in said selected areas to form a hollow assembly; and (g) carrying out finishing operations on said hollow assembly to obtain said hollow blade.

Depending on applications, either one or two intermediate sheets will generally be used.

The outer metal sheets may be obtained by hot forming from parts of reducing thickness or by extrusion forming using known hot die or isothermic forging processes. The or each intermediate sheet may be subjected to a chemical machining operation either before or after step (b) of the method, for example to vary the thickness of the sheet in a desired manner. Other features and advantages of the invention will become apparent from the following description of Preferred embodiments of the invention.

BRIEF DESCRIPTION OF THE DRAWINGS

FIG. 1 is a diagrammatic perspective view of the primary components of a blade after step (b) in the manufacture of the blade by a method in accordance with the invention.

FIG. 2 is a diagrammatic perspective view of an intermediate metal sheet of variable thickness such as may be used in the method of the invention.

FIGS. 3, 3A, 3B, 3C and 3D are diagrammatic representations showing possible constructional details of the intermediate sheet shown in FIG. 2.

FIG. 4 diagrammatic perspective view of an intermediate sheet after the application of diffusion barriers in step (c) of the method in accordance with the invention.

FIG. 5 is a diagrammatic perspective view of the assembled components for forming the blade.

FIG. 6A–6B is a diagrammatic illustration of the diffusion welding of the components in step (e) of the method of the invention.

FIG. 7 is a diagrammatic illustration of the components after inflation and superplastic deformation in step (f) of the method of the invention.

FIGS. 8 and 9 are diagrammatic sectional views showing alternative constructions of blades which may be produced by the method in accordance with the invention.

DESCRIPTION OF THE PREFERRED EMBODIMENTS

Some of the steps in one embodiment of the manufacture of a hollow blade for a turboshaft engine by a method according to the invention are shown diagrammatically in FIGS. 1 to 7, the primary components of the blade comprising two outer metal sheets 1 fitted with lugs 2 and a single intermediate metal sheet 7. These primary components may be made by any suitable known technique.

FIG. 1 shows the components 1 and 7 after they have been curved and twisted by a known hot forming process using tooling which is not shown in the drawings.

Before curving and twisting, a chemical machining operation may be carried out on the intermediate sheet 7 so as to obtain a specific mass distribution in the blade through thickness control.

Alternatively, depending on applications, it may be preferable to carry out the chemical machining of the intermediate sheet 7, such as illustrated in FIGS. 2,3A and 3B, after the curving and twisting operation.

In this case, the chemical machining results in a sheet of varying thickness. FIGS. 3A and 3B represent the said sheet 7 after chemical machining, showing sections in a direction perpendicular to the edges of the blade to be produced and in a direction parallel to these edges.

In particular, it is possible to obtain in the intermediate sheet 7 three areas of different thicknesses *7a,7b* and *7c* as shown in FIGS. 2 and 3A, and/or areas of variable thickness in the perpendicular direction as shown in FIG. 3B.

These operations are carried out by known chemical machining techniques, for example using masks, laser cutouts, etc.

The intermediate sheet 7 is then provided with diffusion barriers defining welding areas 12, as shown in FIG. 4. The areas of application of the diffusion barriers are defined using a mask which may be formed by rigid or flexible tooling, or a deposit of a known material adhering to the surface, which will be cutout or peeled, to form a diffusion barrier in the course of welding and unmasking.

The next stage of the method is the assembly of the primary components, i.e. the outer sheets 1 and the intermediate sheet 7, to form a blade blank 11, the assembly lugs 2 being used as shown in FIG. 5. This assembly operation also includes the preparation of the blank 11 for the subsequent operations.

FIG. 6 illustrates the placing of the blade blank 11 on process tooling which includes pressurizing gas inlets 15 and suitable sealing arrangements. In the example shown, sealing between the inside and the outside of the tooling is effected by a separate seal 16, and sealing between the inside of the blade and the inside of the tooling is effected by peripherally welding the assembly 11 as indicated at 13 in FIG. 5. Depending on the tooling used however, the sealing of the tooling relative to the outside and of the inside of the blade assembly relative to the inside of the tooling may be effected with the aid of a seal produced directly by plastic flow and diffusion welding of the outer outline of the assembly. In this case, the impression of the seal will be eliminated during the blade finishing operations.

The diffusion welding stage of the method is carried out in a furnace. In an embodiment involving titanium alloy components, the operation is carried out at a temperature of 930° C. and a neutral gas, such as argon, is used to pressurize the assembly 11 as shown diagrammatically by the arrows 17. In one example the pressure applied is 4MPa. The welds 18 between the intermediate sheet 7 and the outer sheets 1 are arranged alternately on opposite sides of the sheet 7 as shown in FIG. 6.

The blade blank 11 is then held in position on the tooling 14 for the operation of inflation and superplastic deformation by pressurized argon using the gas manifold previously placed in position and the gas inlets made during the earlier operation of chemically machining the intermediate plate 7 and during the setting up of the blank 11 on the tooling 14. This operation provides the blade blank 11 with the final internal shape of the blade, such as shown in FIG. 7.

It then remains only to carry out the finishing operations necessary to obtain the final external shape of the blade 11. These finishing operations, which generally involve machining with cutting of the blade outline and removal of the attachments, finishing of the leading and trailing edges of the blade 11, and finishing of the blade root, are all well known techniques. It will be noted that, before finishing, the leading and trailing edges of the blade may have a configuration which is close to their final form.

The method of manufacturing a hollow blade for a turboshaft engine which has just been described may be applied, without departing from the scope of the invention, to blades having different constructions. In particular, instead of a single intermediate sheet 7, a plurality of intermediate sheets may be used, of which at least one has a continuous surface like the sheet 7 forming part of the construction described above with reference to FIGS. 1 to 7. In addition, one or more additional intermediate sheets may be used having, for example, a part which is cut away in the center so as to reinforce the edges of the blade eventually obtained.

In another embodiment two intermediate sheets may be used so as to obtain a blade structure as shown diagrammatically in cross-section in FIG. 8, wherein the outer sheets 1 are associated with two intermediate sheets 19 and 20. Depending on the application, other structures may also be sought such as shown in FIG. 9. In all cases, connections by diffusion welding are established between the different sheets and an operation of inflation and superplastic deformation using pressurized gas is applied, in accordance with the invention, after the assembly has been subjected to a curving and twisting operation.

It will be noted also that the method in accordance with the invention permits, if desired, the use of a different material for the intermediate sheets and for the outer sheets. For example, the material of the outer sheets may not have the same properties of superplasticity as that of the intermediate sheets.

We claim:

1. A method of manufacturing a hollow blade for a turboshaft engine, particularly a fan rotor blade of large chord, said method comprising the following steps:

(a) providing primary components comprising two outer metal sheets and at least one intermediate metal sheet;

(b) hot forming said primary components wherein said components are curved and twisted to a desired shape;

(c) putting in place diffusion barriers at selected positions on said at least one intermediate sheet;

(d) assembling and putting said components in place on suitable process tooling;

(e) diffusion welding said assembled components together at said selected positions of said diffusion barriers, wherein said diffusion welding step is performed after said hot forming step such that the diffusion welding is performed upon components which have been curved and twisted to a desired shape during said hot forming step;

(f) internally gas pressurizing selected areas of the welded assembly of said primary components to inflate and superplastically deform said assembly in said selected areas to form a hollow assembly; and (g) carrying out finishing operations on said hollow assembly to obtain said hollow blade.

2. A method according to claim 1, wherein before step (b), said at least one intermediate sheet is subjected to a chemical machining operation.

3. A method according to claim 1, wherein between steps (b) and (c), said at least one curved and twisted intermediate sheet is subjected to a chemical machining operation so as to vary the thickness of the sheet.

4. A method according to claim 1, wherein said primary components comprise two outer metal sheets and a plurality of intermediate metal sheets.

5. A method according to claim 4, wherein said intermediate sheets include at least one sheet with a continuous surface and at least one sheet with a cut away central part.

6. A method according to claim 4, in which there are two intermediate sheets, said two intermediate sheets being diffusion welded to said outer sheets and being inflated and superplastically deformed by gas pressurization in steps (e) and (f).

7. A method of manufacturing a hollow blade for a turboshaft engine comprising:

(a) providing at least three primary components comprising two outer metal sheets and at least one intermediate metal sheet;

(b) hot forming said at least three primary components such that said at least three primary components are curved and twisted to a desired shape and such that each of said at least three primary components includes curved and twisted surfaces;

(c) placing diffusion barriers at selected portions on said at least one intermediate sheet;

(d) assembling and putting said at least three components having curved and twisted surfaces in place on suitable process tooling;

(e) diffusion welding said assembled components together at selected positions, wherein said diffusion welding step if performed after said hot forming step such that the diffusion welding is performed upon curved and twisted surfaces of said three primary components formed during said hot forming step;

(f) internally gas pressurizing selected areas of the welded assembly of said at least three primary components to inflate superplastically deform said assembly to form a hollow assembly; and (f) carrying out finishing operations on said hollow assembly to obtain said hollow blade.

8. The method of claim 7, further including providing a plurality of intermediate sheets.

* * * * *

UNITED STATES PATENT AND TRADEMARK OFFICE

CERTIFICATE OF CORRECTION

PATENT NO. : 5,253,419

DATED : October 19, 1993

INVENTOR(S) : ANDRE C.F. COLLOT ET AL

It is certified that error appears in the above-indentified patent and that said Letters Patent is hereby corrected as shown below:

In column 2, line 27, after "FIG. 4" insert --is a--.

In column 6, line 15, change "(f)" to --(g)--.

Signed and Sealed this

Fifteenth Day of November, 1994

Bruce Lehman

*Attest:*

BRUCE LEHMAN

*Attesting Officer*

*Commissioner of Patents and Trademarks*